US006672030B2

(12) United States Patent
Schulte

(10) Patent No.: US 6,672,030 B2
(45) Date of Patent: Jan. 6, 2004

(54) METHOD FOR LAYING FLOOR PANELS

(76) Inventor: Johannes Schulte, Zum Walde 16, 59602 Rüthen-Metate (DE)

( * ) Notice: Subject to any disclaimer, the term of this patent is extended or adjusted under 35 U.S.C. 154(b) by 88 days.

(21) Appl. No.: 10/041,952

(22) Filed: Jan. 8, 2002

(65) Prior Publication Data

US 2002/0092263 A1 Jul. 18, 2002

(30) Foreign Application Priority Data

Jan. 16, 2001 (DE) ..... 101 01 912

(51) Int. Cl.[7] ..... E04B 5/00

(52) U.S. Cl. ..... 52/747.1; 52/539; 52/591.1; 52/592.1; 52/592.4; 52/589.1; 52/DIG. 1

(58) Field of Search ..... 52/747.1, 591.1, 52/592.1, DIG. 1, 589.1, 592.4, 70, 71, 539, 514.5, 747.11, 747.12, 747.13; 428/58, 60, 192

(56) References Cited

U.S. PATENT DOCUMENTS 2,430,200 A * 11/1947 Wilson
5,295,341 A * 3/1994 Kajiwara ..... 52/586.2
5,706,621 A * 1/1998 Pervan ..... 52/403.1
5,860,267 A * 1/1999 Pervan ..... 52/748.1
5,887,406 A * 3/1999 Bond ..... 52/749.1
6,023,907 A 2/2000 Pervan
6,094,882 A * 8/2000 Pervan ..... 52/745.19
6,233,899 B1 * 5/2001 Mellert et al. ..... 52/747.1
6,332,733 B1 * 12/2001 Hamberger et al. ..... 403/329
6,418,683 B1 * 7/2002 Martensson et al. ..... 52/282.1
6,546,691 B2 * 4/2003 Leopolder ..... 52/747.1

FOREIGN PATENT DOCUMENTS

DE 4215273 A1 * 11/1993
FR 2691491 * 5/1992
WO WO 01/02671 A1 * 1/2001

* cited by examiner

*Primary Examiner*—Jeanette Chapman
(74) *Attorney, Agent, or Firm*—Henry M. Feiereisen

(57) ABSTRACT

In a method of laying floor panels having circumferential tongues, receiving grooves, locking grooves and locking lips, a first row of floor panels is joined through interlocking engagement of the shorts sides. The connection of the floor panels of each subsequent row of floor panels is implemented through attachment along their shorts sides as well as attachment of their long sides with the long sides of each preceding row of floor panels, by using wedges by which neighboring floor panels can be reliably pushed together in longitudinal and transverse directions, while at least partially engaging, without play, the locking lips with the locking grooves as well as the tongues in the receiving grooves.

9 Claims, 7 Drawing Sheets

METHOD FOR LAYING FLOOR PANELS

CROSS-REFERENCES TO RELATED APPLICATIONS

This application claims the priority of German Patent Application Serial No. 101 01 912.2, filed Jan. 16, 2001, the subject matter of which is incorporated herein by reference.

BACKGROUND OF THE INVENTION

The present invention relates to a method of laying floor panels, in particular rectangular floor panels.

U.S. Pat. No. 6,023,907 discloses a method of laying rectangular floor panels having two long sides and two short sides, wherein one long side and one short side have projecting tongues and floor-proximal locking grooves at a lateral distance to the tongues. The other long side and other short side are formed with receiving grooves, which complement the tongues, and with projecting fins beneath the receiving grooves, terminating in upwardly open locking lips. The locking lips have a contour that substantially complements the locking grooves.

The floor panels are laid in several parallel rows by initially joining a first row of floor panels along their first and second short sides such that, after placement of a first floor panel on the floor, the subsequent floor panel is positioned in longitudinal direction at an inclination to push its tongue on the short side into the receiving groove on the confronting short side of the first floor panel, and subsequently urged downwards into a same plane as the first floor panel so that the locking lip on the second short side of the first floor panel is engaged in the locking groove on the first short side of the subsequent floor panel. When the floor panels are joined together, they can occupy a relative position that there is a play between the locking lip and the locking groove in a direction transversely to the interface. Subsequently, the first floor panel of the second row is placed by engaging the tongue at its long side in a receiving groove at the long side of at least one floor panel at an end of the first row, while being inclined in transverse direction, and at a same time a further floor panel of the second row is joined at a lateral distance to the previously laid floor panel by engaging the tongue at the short side with the first floor panel of the second row, while being inclined in longitudinal direction, and subsequently moved into the oblique plane of the previously laid floor panel of the second row. Then, both floor panels are further urged downwards until the locking lips engage along the long sides of the previously laid first row into the locking grooves of the floor panels of the second row. A play between the locking lips and the locking grooves should be provided also along the long sides after joining operation. All floor panels of the second row as well as all subsequent rows are laid thereafter in a same manner.

This method suffers shortcomings because, during placement and swinging of the floor panels of the second and each further row, the installer has to handle at least two floor panels simultaneously and angle them relative to one another in various positions. As a result, a reliable joining operation is hardly attainable. Rather, the floor panels may edge so that the locking lips may get damaged at the projecting fins. Therefore, successive floor panels in one row and/or floor panels of neighboring rows cannot be reliably joined together, unless at least two installers work together during laying of the floor panels. This, however, substantially increases the manufacturing costs. In particular, when walking on the tread or top surface of the laid flooring, the visual appearance of the top surface is marred by the presence of gaps and openings. Moreover, the longitudinal and transverse edges adjacent the top surface can get damaged, when joining the floor panels, thereby further adversely affecting the look of the flooring.

It would therefore be desirable and advantageous to provide an improved method of joining floor panels, obviating prior art shortcomings and allowing a simple and rapid laying of floor panels, without damage to the locking lips and to the longitudinal and transverse edges of the floor panels adjacent the tread surface.

SUMMARY OF THE INVENTION

According to one aspect of the present invention, a method of laying floor panels includes in an initial phase placement of a floor panel of a first row of floor panels in a corner area of the floor area being covered such that the one long side and the one short side formed with the receiving grooves and the locking lips points toward the floor area to be covered. Subsequently, a next floor panel is positioned at an inclination in longitudinal direction such that the tongue on one short side is pushed upon the other short side of the first floor panel until the end face of the one short side of the next floor panel abuts against the transverse edge of the first floor panel, and is then urged downwards into the plane of the previously laid first floor panel, whereby the locking lip of the first floor panel is in engagement without play with the locking groove of the next floor panel. The remaining floor panels of the first row are joined in a same manner.

The process can be reliably carried out in a simple and rapid manner by a single installer.

According to a variation of the present invention, the initial phase of laying the first row of floor panels may also be carried out in such a way that after initial placement of a floor panel of a first row of floor panels in a corner area of the floor area being covered, each further floor panel is joined through parallel displacement with respect to the previously laid floor panel. In this manner, the tongue at the one short side of the further floor panel slides into the receiving groove of the other short side of the previously laid floor panel, and the locking lip at the other short side of the previously laid floor panel slides into the locking groove at the one short side of the further floor panel, until both floor panels are aligned in a straight line in the first row.

Once the first row of floor panels is laid by either one of the aforementioned ways, a first floor panel of the second row is positioned at an inclination in transverse direction at the end at which the laying of floor panels for the first row has started, whereby the first floor panel of the second row is placed with respect to at least one floor panel of the first row until the end face of one long side rests against the longitudinal edge on the confronting long side of the previously laid floor panel of the first row so that the tongue at the long side of the new floor panel engages in the receiving groove at the long side of the confronting floor panel of the first row. Before joining the first floor panel of the second row, an installation wedge is, however, placed in the area of the first floor panel of the second row. The wedge is positioned transversely and loosely abuts the first row of floor panels, with its beveled surface pointing toward the first row. After joining the first floor panel of the second row with floor panels of the first row, the first floor panel of the second row is lowered in the direction of the wedge so that the locking lip at the long side of the respective floor panel in the first row partially engages, without play, in the locking groove of the confronting long side of the first floor panel of the second row. Once the first floor panel of the second row rests on the wedge, this partial engagement of locking lip and locking groove is sufficient to prevent a detachment of this floor panel from the previously laid floor panel of the first row. A tension-proof connection is hereby realized of the first floor panel of the second row with the floor panels of the first row.

Before placement of a next floor panel of the second row can proceed, a further installation wedge is positioned approximately in mid length section of the next floor panel of the second row in transverse direction and loosely placed against the first row. The new floor panel of the second row can then be laid at a lateral distance to the first row at an inclination in longitudinal direction until the end face at the short side abuts against the transverse edge of the confronting short side of the previously laid floor panel of the second row, which rests on the wedge, so that the tongue at the short side of the new floor panel engages the receiving groove at the short side of the previously laid floor panel of the second row. Thereafter, the new floor panel of the second row is moved downwards until resting on the further wedge, resulting in a complete engagement, without play, of the locking lip and the locking groove of both floor panels of the second row at their confronting short sides, while still allowing a sliding displacement relative to one another. Thus, the installer is required to handle only the floor panel being added.

Next, it is only required to slightly move upwards the interlocked floor panels of the second row, while retaining the engagement of the tongue at the long side of the first floor panel of the second row with the receiving groove of at least one of the floor panels of the first row, i.e., the partial lock between both rows is negated in order to allow easy displacement of the second floor panel of the second row into the plane of the first floor panel in the direction of the first row, until also the tongue at the long side of the second floor panel engages the receiving groove at the long side of a floor panel of the first row. Thereafter, both floor panels of the second row are lowered onto the wedges so that these floor panels are partially locked, free of play, as a consequence of an engagement of their locking grooves by the locking lips of the floor panels of the first row, and a transverse displacement in their plane is no longer possible relative to the first row of floor panels.

When being joined to the first floor panel of the second row, it is only required to ensure that the lateral distance of the second floor panel of the second row with respect to the first row is sufficient that the end face of the tongue at the long side of the second floor panel extends next to the end face of the projecting fin of the floor panels of the first row.

The further floor panels of the second row can then be laid in a same manner as the second floor panel of the second row.

Once all floor panels of the second row have been laid, the installation wedges are removed, and the entire second row of floor panels is lowered onto the floor whereby a complete engagement, without play, of the locking lips at the long side of the floor panels of the second row with the locking grooves at the long side of the floor panels of the first row. Both rows are now reliably joined together in a tension-proof and compression-proof manner.

These above-stated assembly steps can be repeated to add further rows of floor panels.

The method according to the present invention allows easy laying of floor panels without any need for adhesives. Risk of damage to the locking lips upon the tongues or to the longitudinal and transverse edges of the floor panes adjacent to the tread surface is eliminated. A single installer can carry out the successive installation steps in order to reliably lay the floor panels with a visually pleasing look, without gaps or spaces in the flooring.

According to another feature of the present invention, the floor panels may be fixed in place either during or after joining, when local conditions warrant this. The fixation may be realized, for example, by shims, when the area to be covered is in a room. The shims may then be inserted in gaps between the walls and the outer perimeter of the area covered by floor panels.

The present invention is also directed to the provision of an installation wedge for carrying out the method according to the present invention. Thus, in accordance with another aspect of the present invention, the height of the lower end of the installation wedge and the inclination of the installation wedge with respect to the horizontal, are so suited to the height of a locking lip and to the depth of a locking groove of another long side of a floor panel that each floor panel of a row, which rests on an installation wedge and is joined with a floor panel of a previously laid row by a tongue and groove structure along their long sides, is also partially locked, without play, via its locking groove at the long side with the locking lip at the long side of a floor panel of a previously laid row, i.e. is secured in place against detachment. When subsequently attaching a further floor panel in a further row, there is only a need to slightly move upwards these two floor panels from the wedges, after joining the short sides of the further floor panel with the previously laid floor panel, in order to reverse the partial locked engagement. The floor panel of the further row, to be attached, can then guided along the short sides in parallel relationship to the first floor panel in the direction of the previous row, until its tongue at the long side engages the receiving groove at the long side of the first row, while the end face of the long side abuts against the longitudinal edge of a placed floor panel of the first row. Subsequently, both floor panels are again lowered onto the surfaces of the wedges so that all locking lips at the long side can partially engage, without play, in the locking grooves at the long side to thereby join together both floor panels of the further row with the preceding row in a tension-proof manner.

According to another feature of the present invention, the installation wedge may have a length, which is greater than a width of a floor panel. In this way, handling of the wedges is facilitated, especially when removing them after laying a row.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
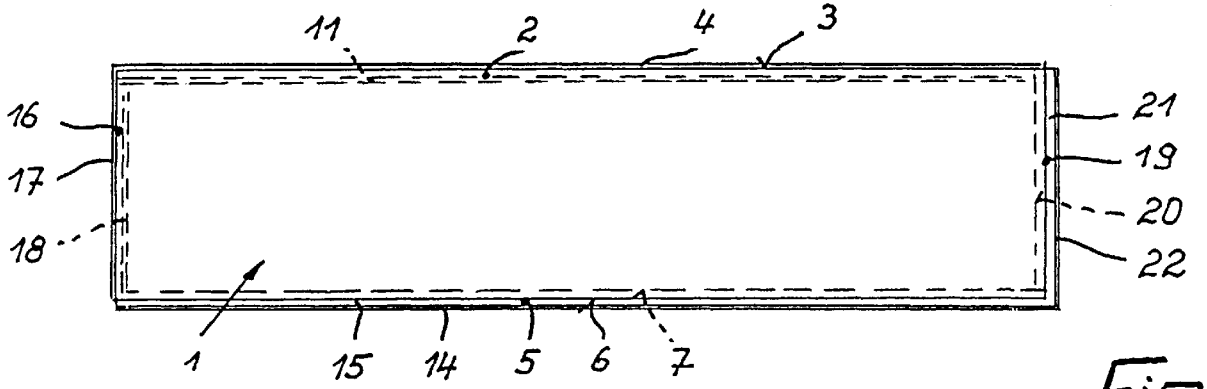
FIG. 1 is a top view of a floor panel.

Throughout all the Figures, same or corresponding elements are generally indicated by same reference numerals.

Figure 9:
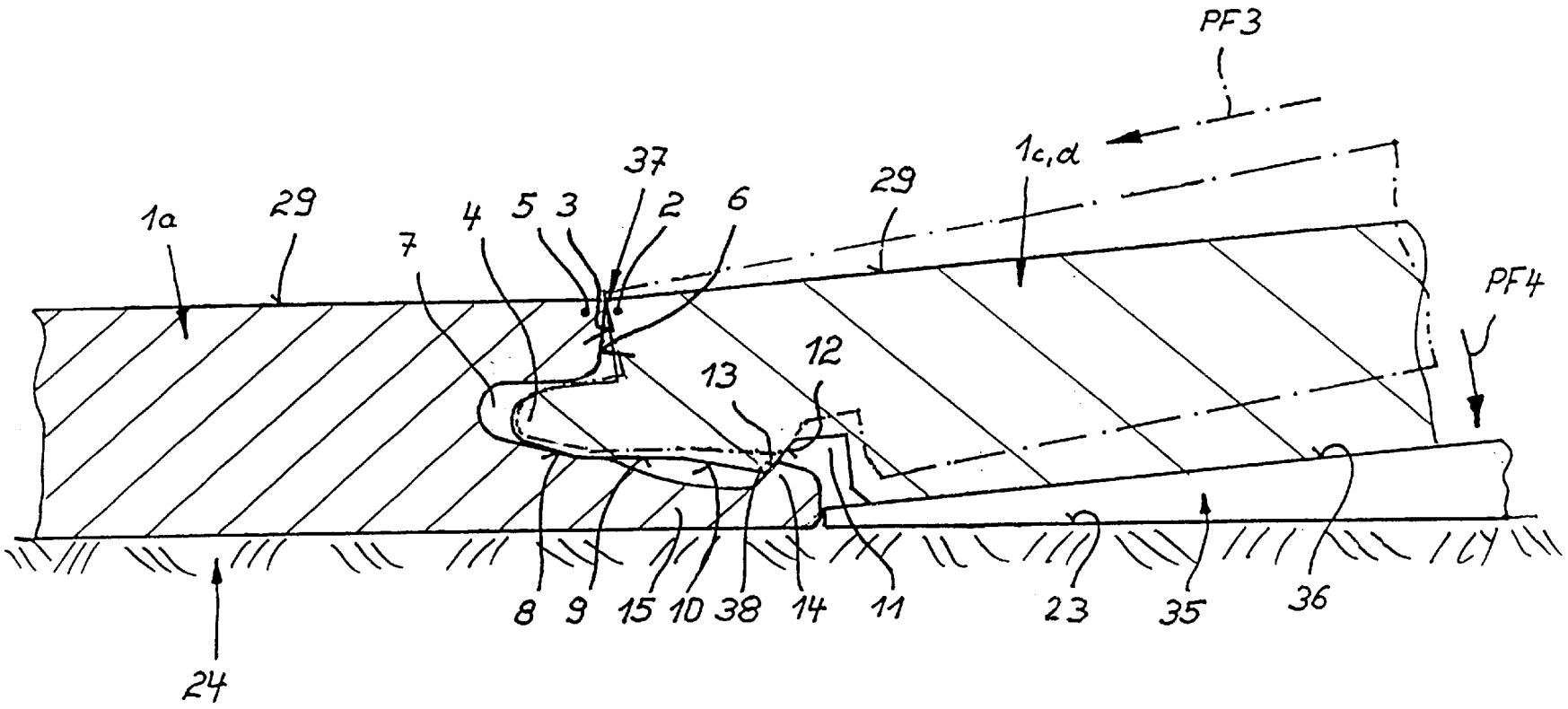
FIG. 9 is an enlarged detailed view of an area, marked IX and encircled in FIG. 8.

Turning now to the drawing, and in particular to FIG. 1, there is shown a top view of a rectangular floor panel, generally designated by reference numeral 1 and made of solid wood or laminate. The floor panel 1 has opposite long sides 2, 5 and opposite short sides 16, 21. The long side 2 includes an end face 3 and is formed with a tongue 4 which projects horizontally beyond the end face 3. At the other long side 5, the floor panel 1 has an end face 6 which has formed therein a receiving groove 7 which substantially complements a contour of the tongue 4. This is best seen in FIG. 9, which also shows that the tongue 4 is formed with a stepped bottom side defined by slanted surfaces 8, 9, 10. The long side 2 of the floor panel 1 is further provided at its bottom side inwardly of the tongue 4 with a receiving groove 11 which has a generally trapezoidal configuration to substantially complement an inclined support surface 12 of an inclined counter surface 13 of a triangular locking lip 14 formed at an end of a projecting fin 15 of the long side 5. The fin 15 extends beneath the receiving groove 7 and projects beyond the end face 6.

Figure 3:
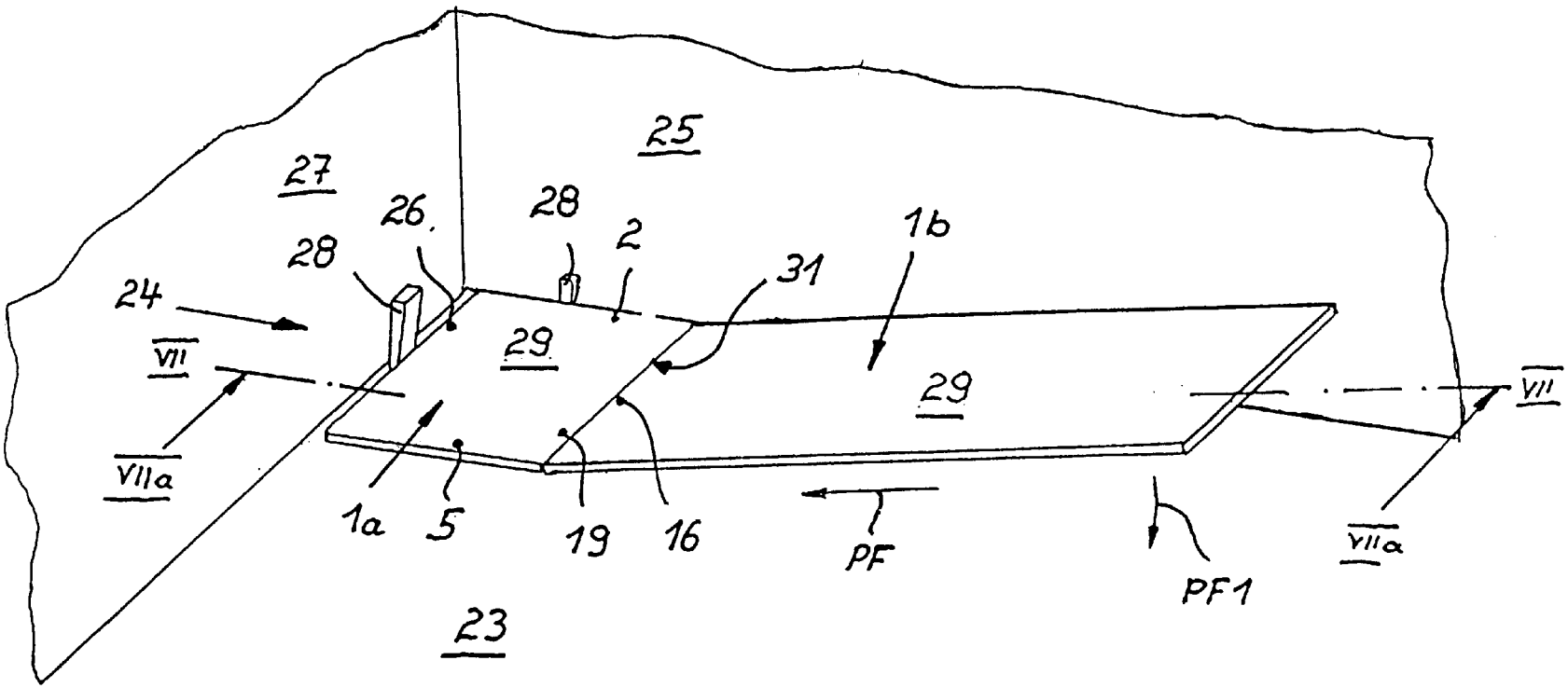
FIG. 3 is a perspective illustration of a floor at the beginning phase of laying a first row of floor panels upon an area in accordance with a second variation of a laying method according to the present invention.

As shown in FIGS. 1 and 3, the short side 16 of the floor panel 1 has a tongue 17 and is formed at its bottom side inwardly of the tongue 17 with a locking groove 18 of a contour analogous to the receiving groove 11. The opposite short side 19 of the floor panel 1 is formed with a receiving groove 20, which complements the tongue 17, and with a projecting fin 21 terminating in a locking lip 22 which complements the locking groove 18 and has a configuration analogous to the locking lip 14.

With reference to FIGS. 2 to 9, laying of floor panels 1 upon an area, e.g. a floor 23 of a room, will now be described in more detail. In order to facilitate understanding of the present invention, the following description refers to floor panels 1*a*, 1*b*, 1*c*, 1*d*, when in fact the floor panels are identical. It is also noted that FIGS. 3 to 6 show the floor panels 1 without detailed configuration of their periphery for sake of simplicity.

Figure 4:
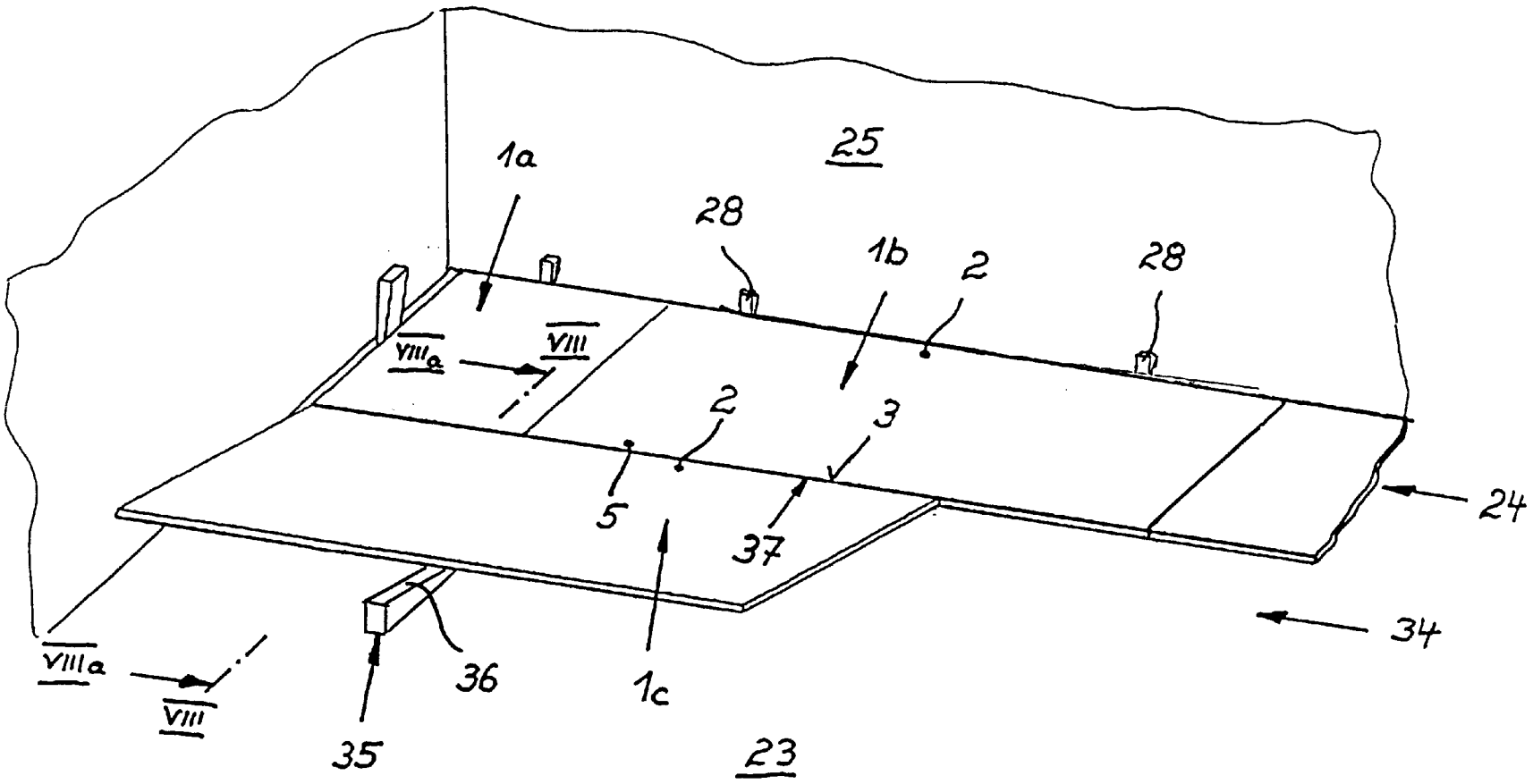
FIG. 4 is a perspective illustration of the floor, showing the beginning phase of laying a second row of floor panels.

As shown in FIG. 3, a first row 24 of floor panels 1 is laid by initially using a floor panel 1*a* which has been cut in half and placed flat on the floor 23 in a corner of the room in such a way that the long side 5 with the locking lip 14 and the short side 19 with the locking lip 22 point into the room. Shims 28 are placed between the long side 2 and the adjacent wall 25 as well as between the partition side 26 of the halved floor panel 1*a* and the adjacent wall 27. After positioning the floor panel 1*a* in this fashion, a new floor panel 1*b* is attached at an inclination in longitudinal direction against the floor panel 1*a*, as indicated by arrow PF, such that the short side 16 of the floor panel 1*b* abuts against the short side 19 of the floor panel 1*a*, and the tongue 17 at the short side 16 of the floor panel 1*b* engages the receiving groove 20 of the short side 19 of the floor panel 1*a*. The short side 16 of the floor panel 1*b* is pressed with its end face 30 upon a transverse edge 31 of the short side 19 of the floor panel 1*a*, adjacent the top or tread surface 29. The inclination of the new floor panel 1*b* with respect to the horizontal is sufficient to allow sliding of a bulbous portion of the tongue 17, bounding the locking groove 18 (FIG. 7), past the locking lip 22. Subsequently, the new floor panel 1*b* is lowered onto the floor 23 in a direction indicated by arrow PF1 so that the floor panels 1*a*, 1*b* are now coupled via their confronting short sides 16, 19 in a same horizontal plane, as shown in FIG. 4 and, by way of dashdot line, in FIG. 7. Further shims 28 may be placed between the long side 2 of the floor panel 1*b* and the adjacent wall 25, as illustrated in FIG. 4. Laying of further floor panels 1 to complete the first row 24 is then repeated accordingly.

Figure 2:
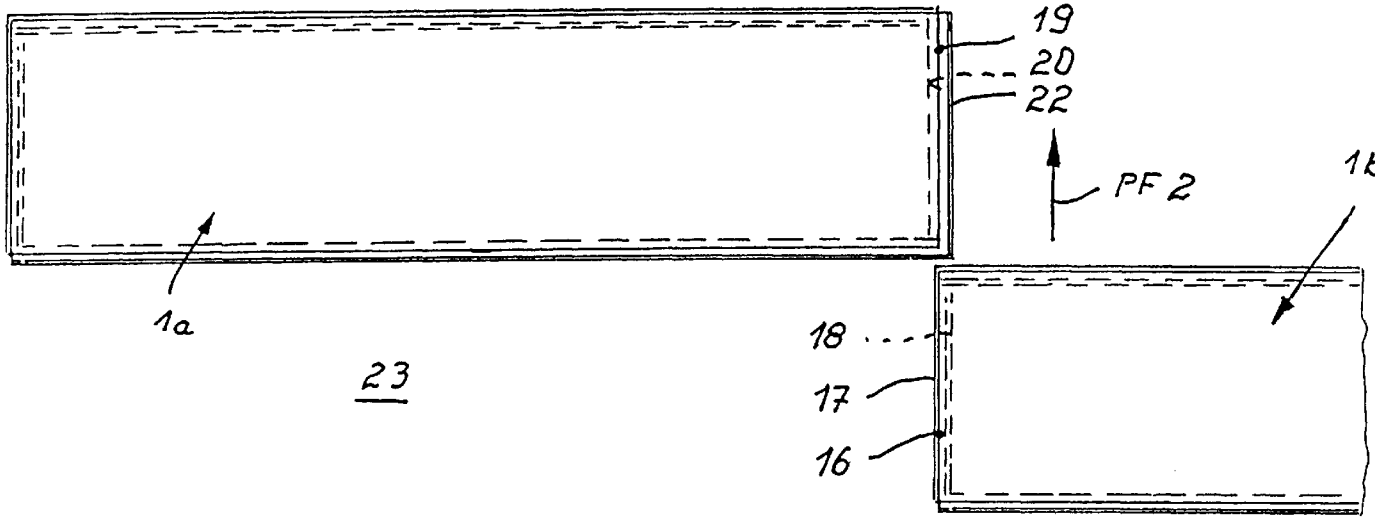
FIG. 2 is a top view of two floor panels according to FIG. 1, placed for subsequent joining in accordance with a first variation of a laying method according to the present invention.

As a consequence of the configuration of the floor panels 1, it is, however, also conceivable to lay the floor panels 1 in a manner indicated in FIG. 2. Hereby, after placement of the first floor panel 1*a* (shown here uncut) in the corner of the floor 23, the new floor panel 1*b* is positioned flat on the floor 23 besides the floor panel 1*a* in a same plane so that the tongue 17 at the short side 16 of the floor panel 1*b* is in alignment with the receiving groove 20 of the short side 19 of the floor panel 1*a*, and the locking groove 18 of the floor panel 1*b* is in alignment with the locking lip 22 at the short side 19 of the floor panel 1*a*. Thus, it is only required to push the new floor panel 1*b* in parallel relationship into the floor panel 1*a*, as indicated by arrow PF2, to realize a tension-proof connection in longitudinal direction. Joining of further floor panels 1 in the first row 24 can be implemented in a same manner.

After laying the first row 24 of floor panels 1 in a manner, as previously described, the second row 34 of floor panels 1 is laid onto the floor 23 by using expendable installation wedges 35 having a beveled surface 36 at an inclination of, e.g., 1%. As shown in FIG. 4, before attachment of a first floor panel 1*c* of the second row 34, an installation wedge 35 is positioned transversely to the longitudinal extension of the floor panels 1 to rest loosely against a floor panel 1 in the first row 24, whereby the beveled surface 36 of the wedge 35 descends toward the first row 24 of floor panels 1. Subsequently, the floor panel 1*c* is attached in a direction indicated by arrow PF3 at an inclination in transverse direction against the first row 24 of floor panels 1 such that the tongue 4 at the long side 2 of the floor panel 1*c* assumes the position, shown in FIG. 9 by dashdot line, until the end face 3 of the floor panel 1*c* abuts against the longitudinal edge 37 at the long side 5 of the floor panel 1 in the first row 24 and the tongue 4 of the floor panel 1*c* engages the receiving groove 7 at the long side 5 of the floor panel 1 of the first row 24. The angle of inclination of the floor panel 1*c* upon attachment is so selected as to ensure sliding of the bulbous portion 38, bounding the locking groove 11, past the locking lips 14 of the floor panels 1 of the first row. Thereafter, the floor panel 1*c* is urged downwards in the direction of arrow PF4 (FIG. 9) until placed upon the surface 36 of the wedge 35.

Suitably, each installation wedge 35 is so configured that the height of its lower end and its inclination with respect to the horizontal are so suited to the height of the locking lip 14 and the depth of the locking groove 11 of a floor panel 1 that the locking lip 14 engages the locking groove 11 only with part of its height, when a floor panel 1 of the second row 34 (here floor panel 1*c*) is attached to a floor panel 1 of the first row 24 (here, e.g. floor panel 1*a* or 1*b*) via the tongue and groove interlocking structure and the end face 3 of the floor panel 1 of the second row 34 abuts against the longitudinal edge 37 of the floor panel 1 of the first row 24 and the floor panel 1*c* is placed on the wedge 35. The support surface 12 of the locking groove 11 and the counter surface 13 of the locking lip 14 slide on another. In this way, the newly attached floor panel 1*c* is secured against detachment from the floor panels 1 in the first row 24.

Figure 5:
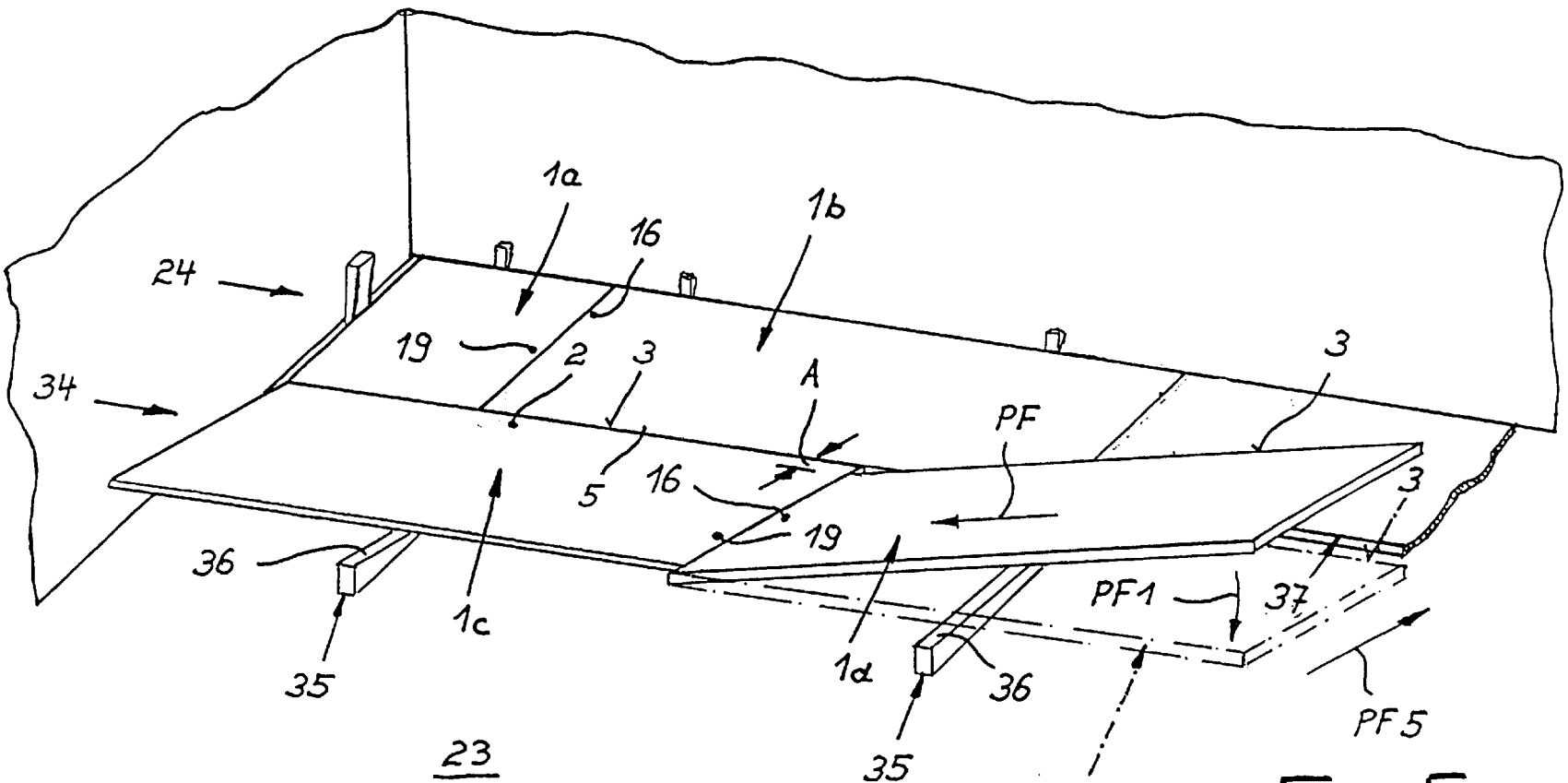
FIG. 5 is a perspective illustration of the floor, showing a subsequent phase of laying the second row of floor panels.
Figure 7:
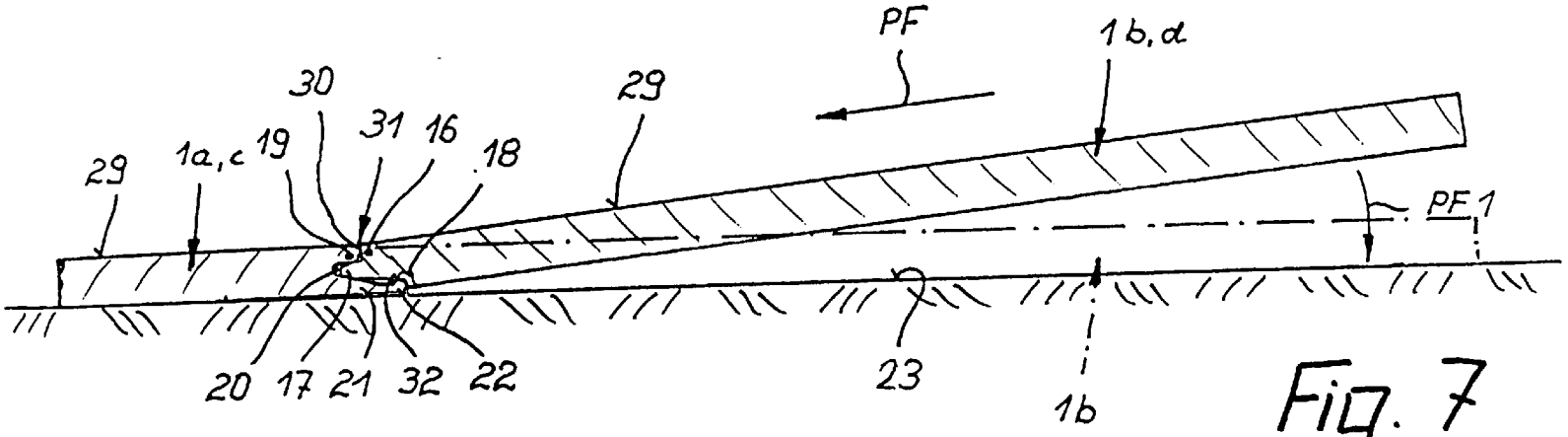
FIG. 7 is an enlarged longitudinal section of two floor panels, taken along the line VII—VII in FIG. 3 and viewed in the direction of arrow VIIa.

A new floor panel 1*d* of the second row 34 can now be joined in a manner as shown in FIGS. 5 and 7, whereby a new installation wedge 35 is placed prior to placement of the floor panel 1*d* approximately in mid-section of the longitudinal extension of the floor panel 1*d* in transverse direction. The floor panel 1*d* is then positioned at an inclination in longitudinal direction and placed at a lateral distance A to the first row 24 in the direction of arrow PF with its tongue 17 at the short side 16 engaging the receiving groove 20 of the short side 19 of the floor panel 1*c* which rests on the wedge 35. Subsequently, the floor panel 1*d* is moved downwards in the direction of arrow PF1 until resting on the wedge 35 so that the locking lip 22 at the short side 19 of the floor panel 1*c* engages the locking groove 18 of the confronting shorts side 16 of the floor panel 1*d*. In this stage, the floor panel 1*d* is positioned in a same plane as the floor panel 1*c* of the second row 34, as indicated by dashdot line in FIG. 5.

Figure 8:
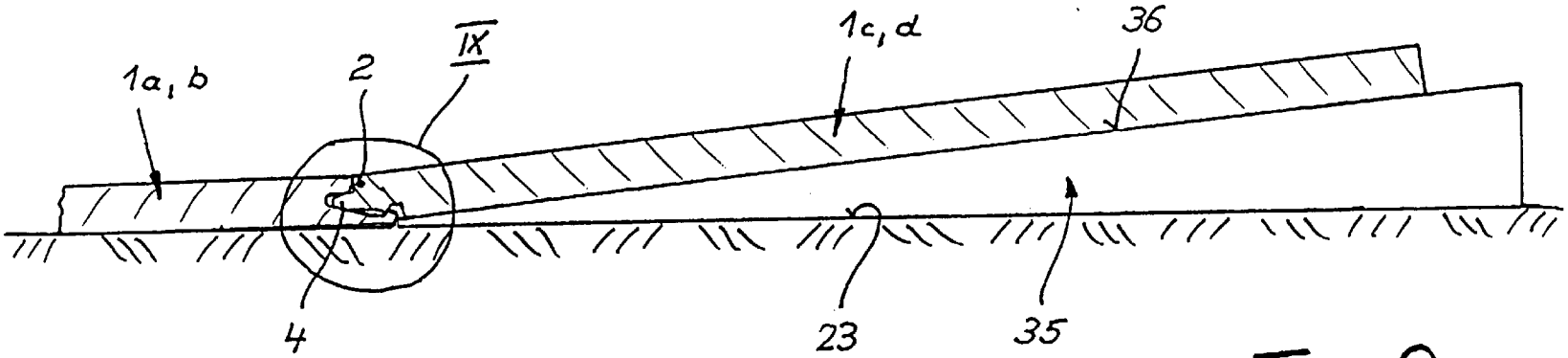
FIG. 8 is an enlarged longitudinal section of two floor panels, taken along the line VII—VII in FIG. 4 and viewed in the direction of arrow VIIIa.

Subsequently, both floor panels 1*c*, 1*d* of the second row 34 are slightly tilted upwards to reverse the partial engagement of the floor panel 1*c* with the first row 24, shown by dashdot line in FIG. 9. In this position, the floor panel 1*d* is guided via the engaging short sides 16, 19 between the floor panels 1*c*, 1*d* and can be shifted in the direction of arrow PF5 toward the first row 24 until the end face 3 abuts against the longitudinal edge 37 of the floor panels 1 of the first row 24. Both floor panels 1*c*, 1*d* can then be urged downwards together until resting upon the wedges 35, thereby implementing again a partial engagement, without play, of both floor panels 1*c*, 1*d* of the second row 24 and the floor panels 1*a*, 1*b* of the first row 24 via the interlocking engagement between the locking lips 14 and the locking grooves 11, as shown in FIGS. 8 and 9.

Figure 6:
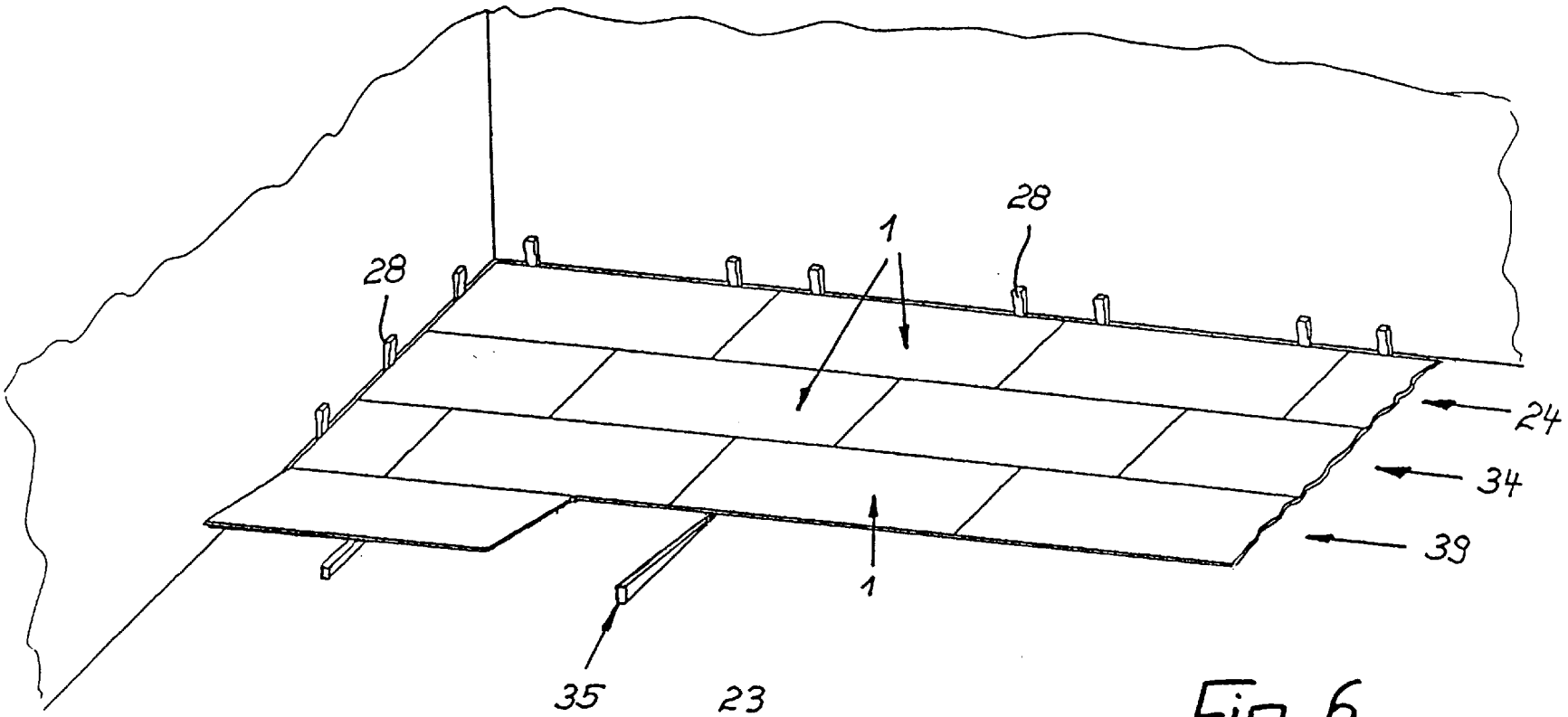
FIG. 6 is a perspective illustration of the floor, showing laying of several rows of floor panels.

After completing the second row 34 of floor panels 1, the wedges 35 are removed and all floor panels 1 of the second row are lowered onto the floor 23 so that the second row 34 extends in a same plane as the first row 24, as shown in FIG. 6. Laying of additional rows 39 on the floor 23 is realized in a same manner as described in conjunction with the second row 34.

While the invention has been illustrated and described as embodied in a method for laying floor panels, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A method of laying rectangular floor panels having first and second long sides and first and second short sides, wherein each of the first long side and first short side is formed in one piece with an outwardly projecting tongue and a floor-proximal trapezoidal locking groove disposed in parallel side-by-side relationship to the tongue and separated from the tongue by a floor-confronting triangular bulbous portion, wherein each of the second long side and second short side is formed with a receiving groove to complement the tongue at the first long side and of the first short side, and in one piece with a projecting fin disposed beneath the receiving groove and terminating in an upwardly pointing triangular locking lip, said method comprising in succession the steps of:

(a) laying a first row of floor panels by joining neighboring floor panels along their confronting first and second short sides such that one of the neighboring floor panels is placed flat on the floor and the other floor panel is initially positioned at an inclination in longitudinal direction to the one floor panel such that the tongue at the first short side of the other floor panel is pushed in the receiving groove of the second short side of the one floor panel until an end face of the first short side of the other floor panel abuts against an upper transverse edge of the one floor panel, and subsequently the other floor panel is lowered into coplanar disposition with the one floor panel while the locking lip at the second short side of the one floor panel is engaged, without play, in the locking groove of the first short side of the other floor panel and the tongue at the first short side of the other floor panel engages, without play, with the receiving groove of the second short side of the one floor panel;

(b) loosely positioning a first wedge transversely upon an end of the first row of floor panels such that a surface of the wedge descends towards the first row of floor panels;

(c) positioning a first floor panel of a second row in inclined disposition in transverse direction such that the tongue at the first long side of the first floor panel of the second row engages in the receiving groove of the second long side of at least one of the floor panels of the first row until an end face of the first long side of the first floor panel of the second row abuts against a longitudinal edge of the at least one of the floor panels of the first row, and subsequently lowering the first floor panel of the second row until resting on the surface of the wedge, whereby the locking lip at the second long side of the at least one of the floor panels of the first row is partially engaged, without play, in the locking groove of the first long side of the first floor panel of the second row;

(d) loosely positioning at least a second said wedge at a lateral distance to the first wedge transversely to the first row of floor panels, placing a second floor panel of the second row at a lateral distance to the first row in inclined disposition in longitudinal direction such that the tongue at the first short side of the second floor panel of the second row engages in the receiving groove of the second short side of the first floor panel of the second row, until an end face of the first short side of the second floor panel of the second row abuts against a confronting transverse edge of the first floor panel of the second row, and lowering the second floor panel of the second row until resting on the surface of the second wedge for coplanar disposition with the first floor panel of the second row resting on the first wedge, whereby the locking lip at the second short side of the first floor panel of the second row is engaged, without play, in the locking groove of the first short side of the second floor panel of the second row and the tongue at the first short side of the second floor panel of the second row is engaged, without play, in the receiving groove of the second short side of the first floor panel of the second row;

(e) upwardly tilting the first and second floor panels of the second row with respect to the wedges, transversely shifting the second floor panel of the second row relative to the previously joined first floor panel of the second row to attach the first long side of the second floor panel of the second row with the second long side of at least one of the floor panels of the first row though engagement of the tongue at the first long side of the second floor panel of the second row in the receiving groove of the second long side of the at least one of the floor panels of the first row until the end face of the first long side of the second floor panel of the second row abuts against the longitudinal edge of the at least one of the floor panels of the first row, and lowering the first and second floor panels of the second row onto the surfaces of the first and second wedges, whereby the locking lip at the second long side of the floor panels of the first row is partially received in the locking groove of the first long side of the floor panels of the second row;

(f) repeating steps (d) and (e), when necessary, for laying additional floor panels of the second row;

(g) removing the wedges and lowering the floor panels of the second row onto the floor, whereby the locking lips at the second long sides of the floor panels of the first row engage, without play, in the locking grooves of the first long side of the floor panels of the second row, and whereby the tongues at the first long side of the floor panels of the second row engage in the receiving grooves of the floor panels of the first row; and (h) repeating steps (b) to (g), when necessary, for laying additional rows of floor panels.

2. The method of claim 1, and further comprising the step of securing the floor panels locally in place in one of the phases selected from the group consisting of during joining of the floor panels and after joining of the floor panels.

3. A method of laying rectangular floor panels having first and second long sides and first and second short sides, wherein each of the first long side and first short side is formed in one piece with an outwardly projecting tongue and a floor-proximal trapezoidal locking groove disposed in parallel side-by-side relationship to the tongue and separated from the tongue by a floor-confronting triangular bulbous portion, wherein each of the second long side and second short side is formed with a receiving groove to complement the tongue at the first long side and of the first short side, and in one piece with a projecting fin disposed beneath the receiving groove and terminating in an upwardly pointing triangular locking lip, said method comprising in succession the steps of:

(a) laying a first row of floor panels by joining neighboring floor panels along their confronting first and second short sides through parallel displacement of one of the floor panels into a plane of the other floor panel;

(c) positioning a first floor panel of a second row in inclined disposition in transverse direction such that the tongue at the first long side of the first floor panel of the second row engages in the receiving groove of the second long side of at least one of the floor panels of the first row until an end face of the first long side of the first floor panel of the second row abuts against a longitudinal edge of the at least one of the floor panels of the first row, and subsequently lowering the first floor panel of the second row until resting on the surface of the wedge, whereby the locking lip at the second long side of the at least one of the floor panels of the first row is partially engaged, without play, in the locking groove of the first long side of the first floor panel of the second row;

(d) loosely positioning at least a second said wedge at a lateral distance to the first wedge transversely to the first row of floor panels, placing a second floor panel of the second row at a lateral distance to the first row in inclined disposition in longitudinal direction such that the tongue at the first short side of the second floor panel of the second row engages in the receiving groove of the second short side of the first floor panel of the second row, until an end face of the first short side of the second floor panel of the second row abuts against a confronting transverse edge of the first floor panel of the second row, and lowering the second floor panel of the second row until resting on the surface of the second wedge for coplanar disposition with the first floor panel of the second row resting on the first wedge, whereby the locking lip at the second short side of the first floor panel of the second row is engaged, without play, in the locking groove of the first short side of the second floor panel of the second row and the tongue at the first short side of the second floor panel of the second row is engaged, without play, in the receiving groove of the second short side of the first floor panel of the second row;

(e) upwardly tilting the first and second floor panels of the second row with respect to the wedges, transversely shifting the second floor panel of the second row relative to the previously joined first floor panel of the second row to attach the first long side of the second floor panel of the second row with the second long side of at least one of the floor panels of the first row though engagement of the tongue at the first long side of the second floor panel of the second row in the receiving groove of the second long side of the at least one of the floor panels of the first row until the end face of the first long side of the second floor panel of the second row abuts against the longitudinal edge of the at least one of the floor panels of the first row, and lowering the first and second floor panels of the second row onto the surfaces of the first and second wedges, whereby the locking lip at the second long side of the floor panels of the first row is partially received in the locking groove of the first long side of the floor panels of the second row;

(f) repeating steps (d) and (e), when necessary, for laying additional floor panels of the second row;

(g) removing the wedges and lowering the floor panels of the second row onto the floor, whereby the locking lips at the second long sides of the floor panels of the first row engage, without play, in the locking grooves of the first long side of the floor panels of the second row, and whereby the tongues at the first long side of the floor panels of the second row engage in the receiving grooves of the floor panels of the first row; and (h) repeating steps (b) to (g), when necessary, for laying additional rows of floor panels.

4. The method of claim 3, and further comprising the step of securing the floor panels locally in place in one of the phases selected from the group consisting of during joining of the floor panels and after joining of the floor panels.

5. An installation wedge intended for use in a method of laying rectangular floor panels in accordance with claim 1, said installation wedge having a lower end, which is defined by a height, and an inclination with respect to the horizontal, wherein the height and the inclination of the installation wedge are suited to a height of a locking lip at one long side of the floor panel and a depth of a locking groove of another long side of the floor panel, such that the locking lip engages only at a partial height in the locking groove, when neighboring floor panels are joined via a tongue and groove interlocking structure along their long sides, while an end face of one of the floor panels abuts against an upper longitudinal edge of the other one of the floor panels, and when a joined floor panel is placed upon a surface of the installation wedge which has been loosely placed upon a laid row of floor panels.

6. The installation wedge of claim 5, having a length which is greater than a width of a floor panel.

7. An installation wedge intended for use in a method of laying rectangular floor panels in accordance with claim 3, said installation wedge having a lower end, which is defined by a height, and an inclination with respect to the horizontal, wherein the height and the inclination of the installation wedge are suited to a height of a locking lip at one long side of the floor panel and a depth of a locking groove of another long side of the floor panel, such that the locking lip engages only at a partial height in the locking groove, when neighboring floor panels are joined via a tongue and groove interlocking structure along their long sides, while an end face of one of the floor panels abuts against an upper longitudinal edge of the other one of the floor panels, and when a joined floor panel is placed upon a surface of the installation wedge which has been loosely placed upon a laid row of floor panels.

8. The installation wedge of claim 7, having a length which is greater than a width of a floor panel.

9. A method of laying floor panels, comprising the steps of:

(a) laying a first row of floor panels on a floor;

(b) positioning a wedge in a direction transversely to the first row of floor panels such that a lower end of the wedge rests against a floor panel of the first row of floor panels;

(c) attaching one long side of a first floor panel of a second row to a confronting long side of a floor panel of the first row;

(d) placing the first floor panel on the wedge;

(e) positioning a further wedge in a direction transversely to the first row of floor panels at a distance to the first floor panel, such that a lower end of the further wedge rests against a floor panel of the first row of floor panels;

(f) attaching a short side of a second floor panel at a lateral distance to the first row to a confronting short side of the first floor panel of the second row;

(g) placing the second floor panel on the further wedge;

(h) sliding the second floor panel relative to the first floor panel into alignment and into engagement with the first row of floor panels;

(i) repeating steps (e) to (h), when necessary for laying additional floor panels of the second row; and (i) removing the wedges and lowering the floor panels of the second row upon the floor to attain a complete engagement with the floor panels of the first row;

(k) repeating steps (c) to (i), when necessary, for laying additional rows of floor panels.

* * * * *

UNITED STATES PATENT AND TRADEMARK OFFICE

CERTIFICATE OF CORRECTION

PATENT NO. : 6,672,030 B2
DATED : January 6, 2004
INVENTOR(S) : Johannes Schulte It is certified that error appears in the above-identified patent and that said Letters Patent is hereby corrected as shown below:

Column 5,
Line 9, delete "the line VII – VII in Fig. 4" insert -- the line VIII – VIII in Fig. 4 --

Signed and Sealed this

Thirtieth Day of March, 2004

JON W. DUDAS
*Acting Director of the United States Patent and Trademark Office*